United States Patent [19]

Imose

[11] Patent Number: 4,691,898

[45] Date of Patent: Sep. 8, 1987

[54] CONTINUOUS ANNEALING FURNACE FOR METALLIC STRIP

[75] Inventor: Masayuki Imose, Kawanishi, Japan

[73] Assignee: Chugai Ro Co., Ltd., Osaka, Japan

[21] Appl. No.: 807,228

[22] Filed: Dec. 10, 1985

[30] Foreign Application Priority Data

Dec. 28, 1984 [JP] Japan ..... 59-278457

[51] Int. Cl.[4] ..... C21D 9/56

[52] U.S. Cl. ..... 266/89; 266/103; 266/110

[58] Field of Search ..... 266/102, 103, 111, 110, 266/89; 148/150

[56] References Cited

U.S. PATENT DOCUMENTS 4,600,181 7/1986 Falco ..... 266/102

FOREIGN PATENT DOCUMENTS 137009 11/1978 Japan ..... 266/103

54-42804 12/1979 Japan .

38341 3/1984 Japan ..... 266/89

*Primary Examiner*—Christopher W. Brody

*Attorney, Agent, or Firm*—Wenderoth, Lind & Ponack

[57] ABSTRACT

A continuous annealing furnace for a metallic strip, wherein each of a direct firing type non-oxidizing furnace and a forced convection type preheating zone is vertically disposed, with an inlet portion of the former being connected to an outlet portion of the latter, through a radiation type preheating zone which is provided with a direction changing roller at its upper end portion.

3 Claims, 2 Drawing Figures

CONTINUOUS ANNEALING FURNACE FOR METALLIC STRIP

BACKGROUND OF THE INVENTION

1. Field of the Invention:

The present invention generally relates to an annealing process and more particularly, to a continuous annealing furnace for annealing a metallic strip and the like therein.

2. Description of the Related Art:

Conventionally, in the continuous annealing furnace for a metallic strip which is provided with a direct firing type non-oxidizing furnace, there has been proposed, for example, in Japanese Patent Publication No. 54-42804 an arrangement in which exhaust gases generated in the non-oxidizing furnace are led into a convection type preheating zone through a radiation type preheating zone for effectively utilizing heat of the exhaust gases as a preheating source.

In the continuous annealing furnace for the metallic strip as described above, however, since all of the non-oxidizing furnace, the radiation type preheating zone and the convection type preheating zone are horizontally arranged, a total length of the furnace has been long and consequently, there have been a variety of drawbacks in transportation of the metallic strip.

SUMMARY OF THE INVENTION

Accordingly, an essential object of the present invention is to provide an improved continuous annealing furnace for a metallic strip having a total length shorter than that of the conventional type and wherein a space required for installation thereof can be extremely reduced.

Another important object of the present invention is to provide a continuous annealing furnace for a metallic strip of the above described type wherein trouble in transporting of the metallic strip can be fully eliminated, since a tension on the metallic strip may be made smaller.

In accomplishing these and other objects, according to one preferred embodiment of the present invention, there is provided a continuous annealing furnace for a metallic strip, wherein each of a direct firing type non-oxidizing furnace and a forced convection type preheating zone is vertically disposed, with an inlet portion of the former being connected to an outlet portion of the latter, through the radiation type preheating zone which is provided with direction changing means at its upper end portion.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
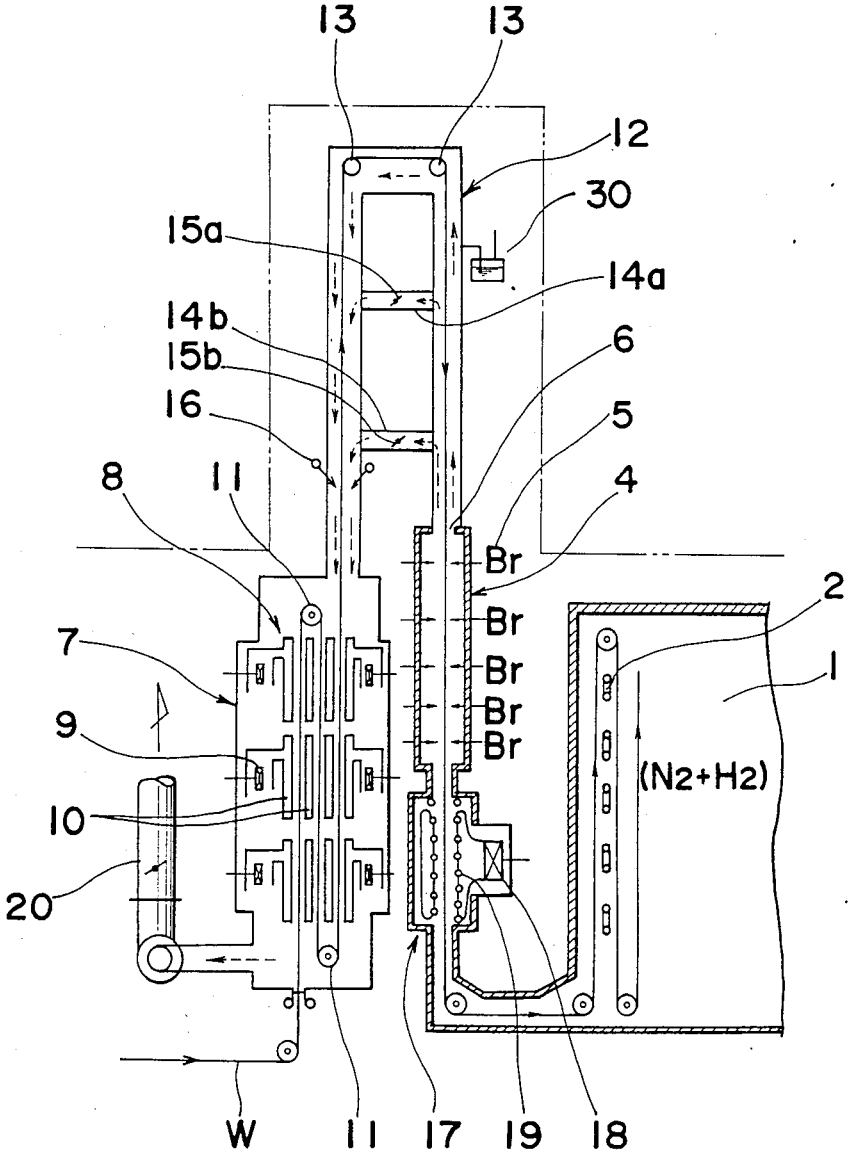
FIG. 1 is a schematic diagram of a continuous annealing furnace for a metallic strip according to one preferred embodiment of the present invention.

Before the description of the present invention proceeds, it is to be noted that like parts are designated by like reference numerals throughout the accompanying drawings.

Referring now to the drawings, there is shown in FIG. 1, a continuous annealing furnace for annealing a metallic strip according to one preferred embodiment of the present invention. The annealing furnace generally includes a radiant tube type atmosphere (mixed gas of $N_2+H_2$) heating zone 1 having a plurality of radiant tubes 2, a direct firing type non-oxidizing furnace 4 having a plurality of burners 5 which burn below a theoretical air ratio, a forced convection type preheating zone 7 having a forced convection means 8 and a radiation type preheating zone 12 through which an inlet portion 6 of the direct firing type non-oxidizing furnace 4 is connected to an outlet portion of the forced convection type preheating zone 7. A buffer zone 17 is vertically arranged between the atmosphere heating zone 1 and the direct firing type non-oxidizing furnace 4.

The direct firing type non-oxidizing furnace 4 and the forced convection type preheating zone 7 are vertically and closely disposed, and connected through the radiation type preheating zone 12 which is generally formed in a shape similar to that of an inverted figure "U".

The above described forced convection means 8 of the forced convection type preheating zone 7 comprises a plurality of recirculation fans 9 and pairs of nozzle headers 10 having a plurality of gas jet nozzles at opposite faces thereof, for moving the metallic strip W vertically in a zigzag manner within the forced convection type preheating zone 7 by means of a set of direction changing rollers 11 and for preheating the metallic strip W by blowing gases from the pairs of nozzle headers 10.

Meanwhile, the radiation type preheating zone 12 includes another set of direction changing rollers 13 at its top portion and two rows of vertical exhaust gas passages facing each other, both of which are connected with each other through exhaust gas by-pass ducts 14*a* and 14*b*, each having a damper 15*a* or 5*b*, respectively. A plurality of air nozzles 16 are arranged at an exhaust gas outlet side of the radiation type preheating zone 12 for burning unburned components of the exhaust gases.

Figure 2:
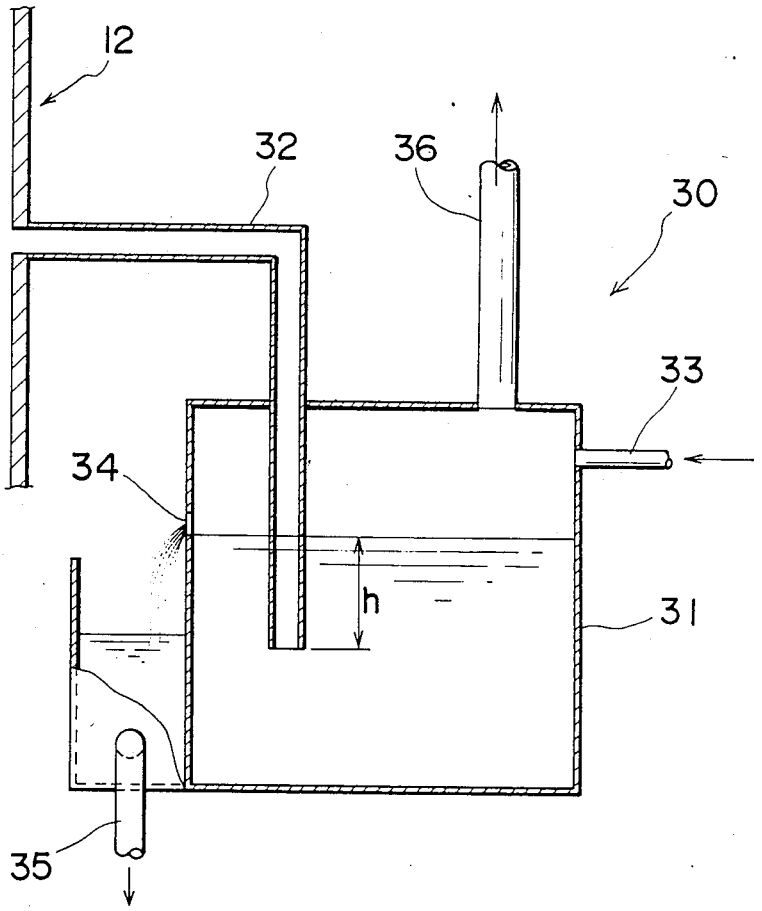
FIG. 2 is a longitudinal sectional view of a pressure relief unit of the continuous annealing furnace for the metallic strip of FIG. 1.

In addition, there is shown in FIG. 2, a pressure relief unit 30 which is arranged in the radiation type preheating zone 12. The pressure relief unit 30 comprises a hermetically sealed receptacle 31 for storing water therein, a connecting pipe 32 having one end immersed into the water in the receptacle 31 and the other end thereof connected to the radiation type preheating zone 12, a supply pipe 33 for supplying water into the receptacle 31, an opening 34 extending through the receptacle 31 for keeping the water level constant because overflowing water passes therethrough, a discharge pipe 35 for discharging water overflowing from the receptacle 31 and an exhaust pipe 36 for exhausting exhaust gases introduced in a space above the water level in the receptacle 31. The pressure relief unit 30 of the above described bubbling type prevents the combustion gases in the direct firing type non-oxidizing furnace 4 from being introduced into the radiant tube type atmosphere heating zone 1 by eliminating abnormal pressure raised momentarily in the direct firing type non-oxidizing furnace 4 where the burners 5 arranged therein ignite prior to on-off control thereof. Furthermore, it is so designed that the head of water corresponding to a length h of a portion of the connecting pipe 32 immersed into water in the receptacle 31 is higher, for example, by approximately 5 $mmH_2O$ than the pressure in the direct firing type non-oxidizing furnace 4 at work.

Subsequently, operations of the annealing furnace having the construction as described so far will be explained hereinafter.

In the first place, the exhaust gases having a high temperature generated in the direct firing type non-oxidizing furnace 4 flow into the radiation type preheating zone 12 for heating the side walls thereof so as to preheat the metallic strip W by radiant heat therefrom. The exhaust gases, then, flow into the forced convection type preheating zone 7 and are pressurized by the fans 9 and are blown from the nozzles at each side of the metallic strip W for preheating it and thereafter, the exhaust gases are discharged through an exhaust gas outlet duct 20.

Reducing atmospheric gases such as dissociated ammonia or the like, are led into the buffer zone 17 and are blown into each face of the metallic strip W by a forced convection means comprising a recirculation fan 18 and a set of nozzle headers 19. However, in a case such as one involving alteration of an operating condition, it is very likely that pickups are undesirably produced on surfaces of the rollers in the radiant tube type atmosphere heating zone 1 due to disturbance of the heating condition in the direct firing type non-oxidizing furnace 4 and resultant oxidation of the surface of the metallic strip W. The buffer zone 17 is advantageously provided for preventing the above described inconvenience by reducing the metallic surface rapidly by means of a forced jet of the reducing atmosphere and in addition, in the usual operation, the buffer zone 17 also prevents the combustion gases in the direct firing type non-oxidizing furnace 4 from being introduced into the radiant tube type atmosphere heating zone 1. Thus, neither production of the pickups similar to the above described ones nor atmospheric pollution occur. The reducing force in the buffer zone 17 can be controlled by changing the quantity of the atmospheric gases which are introduced into the buffer zone 17 or in the composition thereof. Furthermore, if pressure in the buffer zone 17 is made higher than that in the direct firing type non-oxidizing furnace 4, the exhaust gases in the direct firing type non-oxidizing furnace 4 can be effectively prevented from entering into the buffer zone 17.

Meanwhile, since the radiation type preheating zone 12 is provided with the exhaust gas by-pass ducts **14*a* and 14*b*, the dampers 15*a* and 15*b*, the air nozzles 16 and the pressure relief unit 30, when a temperature in the top portion of the radiation type preheating zone 12 rises above a heat-resistance temperature of the direction changing rollers 13, the temperature thereof can be reduced by opening the damper 15*a* or 15*b* suitably so as to by-pass the exhaust gases. In addition, when the exhaust gas temperature around the air nozzles 16 goes above below a predetermined temperature due to a decrease of the combustion quanitty in the non-oxidizing furnace 4 by reason of the alteration of the operating condition, the exhaust gas temperature around the air nozzles 16 can be kept at a temperature whereat the unburned components of the exhaust gases can be completely burned by the assistance of air from the nozzles 16, with a damper 15*a* or 15*b* being suitably opened, thus advantageously eliminating a danger such as an explosion which may undesirably happen in the forced convection type preheating zone 7 and the exhaust gas outlet duct 20**.

Although the present invention has been fully described by way of example with reference to the accompanying drawings, it is to be noted here that various changes and modifications will be apparent to those skilled in the art. Therefore, unless such changes and modifications otherwise depart from the scope of the present invention, they should be construed as included therein.

What is claimed is:

1. A continuous annealing furnace for annealing a metallic strip travelling therethrough, said furnace comprising:

a vertical direct firing type non-oxidizing furnace in which exhaust gases are generated as the metallic strip travels therethrough in a downward vertical direction;

a radiation type preheating zone upstream from said direct firing type non-oxidizing furnace relative to the direction of travel of the metallic strip through said direct firing type non-oxidizing furnace, the exhaust gases generated in said direct firing type non-oxidizing furnace passing back through said radiation type preheating zone, said radiation type preheating zone having a first vertical portion connected at one end thereof to and above one end of said direct firing type non-oxidizing furnace and through which the metallic strip travels in a downward vertical direction before travelling through said direct firing type non-oxidizing furnace, an upper portion extending at one end thereof from the other end of said first portion and through which the metallic strip travels before travelling through said first portion, a second vertical portion connected at one end thereof to the other end of said upper portion and through which the metallic strip travels in an upward vertical direction before travelling through said upper portion, and direction changing roller means in said upper portion and over which the metallic strip is guided in said upper portion for changing the direction of travel of the metallic strip from the upward vertical direction in which the metallic strip travels through said second vertical portion to the downward vertical direction in which the metallic strip travels through said first vertical portion;

a vertical forced convection type preheating zone connected at one end thereof to the other end of said second vertical portion below said second vertical portion and juxtaposed with said direct firing type non-oxidizing furnace and through which the metallic strip travels in an upward vertical direction before travelling through said second portion; and at least one gas bypass duct open to and connected between said first portion and said second portion of said radiation type preheating zone below said upper portion thereof for causing a portion of the exhaust gases passing back through said radiation preheating zone to pass therethrough and bypass said upper portion and said direction changing roller means therein, said at least on gas bypass duct having an adjustable damper therein for selecting the amount of exhaust gases that are caused to pass therethrough.

2. A continuous annealing furnace as claimed in claim 1 and further comprising, a radiant type atmosphere heating zone connected to said firing type non-oxidizing furnace at the other end thereof and through which the metallic strip travels after travelling through said direct firing type non-oxidizing furnace;

a pressure relief means operatively connected to said radiation type preheating zone for immediately eliminating excess pressure created in said direct firing type non-oxidizing furnace when burners therein are ignited to prevent the gases in the direct firing type non-oxidizing furnace from passing into said radiant type atmosphere heating zone.

3. An annealing furnace as claimed in claim 1, wherein said radiation type preheating zone further comprises a plurality of air nozzles adjacent the other end of said second vertical portion for adding air to unburned components of the exhaust gases passing back therethrough from said direct firing type non-oxidizing furnace such that the unburned components may be completely burned.

* * * * *